US010920447B2

(12) United States Patent
Xian

(10) Patent No.: US 10,920,447 B2
(45) Date of Patent: Feb. 16, 2021

(54) TENT PEG AND THE PROCESSING METHOD THEREOF

(71) Applicant: Guangzhou Classic & Fresh Crafts Co., Limited, Guangzhou (CN)

(72) Inventor: Minjin Xian, Guangzhou (CN)

(73) Assignee: GUANGZHOU CLASSIC & FRESH CRAFTS CO. LIMITED, Guangzhou (CN)

( * ) Notice: Subject to any disclaimer, the term of this patent is extended or adjusted under 35 U.S.C. 154(b) by 0 days.

(21) Appl. No.: 16/684,596

(22) Filed: Nov. 15, 2019

(65) Prior Publication Data

US 2020/0232249 A1 Jul. 23, 2020

(30) Foreign Application Priority Data

Jan. 18, 2019 (CN) ..... 2019 1 0046712

(51) Int. Cl.
*E04H 15/62* (2006.01)

(52) U.S. Cl.
CPC ..... *E04H 15/62* (2013.01)

(58) Field of Classification Search
CPC ..... E04H 15/62; E04H 15/32
See application file for complete search history.

(56) References Cited

U.S. PATENT DOCUMENTS

| | | | | |
|---|---|---|---|---|
| 1,059,379 | A * | 4/1913 | McKinney | E04H 15/62 135/118 |
| 5,010,698 | A | 4/1991 | Hugron | |
| 5,832,672 | A * | 11/1998 | Griffiths | E04H 15/003 52/4 |
| 6,938,384 | B1 * | 9/2005 | Hodge | E04H 15/62 135/118 |
| 7,163,021 | B1 * | 1/2007 | Matsushita | E04H 15/62 135/118 |
| 8,973,594 | B2 * | 3/2015 | Burgess | E04H 15/62 135/118 |
| 10,066,417 | B1 * | 9/2018 | Linyard | E04H 15/60 |
| 10,694,716 | B2 * | 6/2020 | Hanson | E04H 12/223 |
| 2004/0099300 | A1 * | 5/2004 | Warren | E04H 15/62 135/118 |
| 2006/0051183 | A1 * | 3/2006 | Powell | E02D 5/801 411/386 |
| 2017/0118923 | A1 * | 5/2017 | Montagano | E04H 12/2215 |

FOREIGN PATENT DOCUMENTS

| | | |
|---|---|---|
| GB | 2524557 | 9/2015 |
| KR | 101124539 | 3/2012 |
| KR | 20120008037 U | 11/2012 |

* cited by examiner

*Primary Examiner* — Noah Chandler Hawk
(74) *Attorney, Agent, or Firm* — JMB Davis Ben-David

(57) ABSTRACT

This invention relates to the technical field of tent accessories, which discloses a tent peg including a tent peg cover, a tent peg prong and a prism shape tent peg body; the tent peg cover and the tent peg prong are made of alloy, the tent peg body is made of carbon fiber, the tent peg cover is disposed on a top side of the tent peg body and the tent peg prong is disposed at the bottom side of the tent peg body, wherein a cut out pattern is provided on the tent peg body.

9 Claims, 4 Drawing Sheets

TENT PEG AND THE PROCESSING METHOD THEREOF

CROSS-REFERENCE TO RELATED APPLICATIONS

This application claims priority to Chinese Patent Application No. 201910046712.X, filed Jan. 18, 2019, the contents of which are incorporated by reference herein in their entirety.

FIELD OF THE INVENTION

The invention relates to the field of tent accessory, and more particularly, to a tent peg and the processing method thereof.

BACKGROUND

Lightweight equipment is a development direction of outdoor sports equipment. More and more tent producers are researching how to reduce the weight of a tent. A tent needs to equip with many tent pegs, so the weight of tent pegs affects the total weight of a tent significantly. Therefore, reducing the weight of each tent peg can reduce the total weight of a tent and the burden of campers, so as to bring more fun to outdoor sports.

There are several types of lightweight tent pegs currently including: plastic tent peg, aluminum alloy tent peg, and carbon fiber tent peg. Among them, the plastic tent peg is thick and heavy because of the low rigidity of plastic material, so it is relatively heavy in weight and low in rigidity. Aluminum alloy tent peg could be easily scratched or even deformed, because aluminum alloy is low in rigidity and could be easily deformed in use. In addition, the density of aluminum alloy is larger than that of other materials such as carbon fiber, therefore the weight of a tent peg is still relatively heavy. Carbon fiber tent peg is usually made into a tube shape, the tube part being usually made from a carbon fiber tube wrapped by carbon fiber cloth, wherein the tube needs to keep integrated to preserve the stress bearing intensity of the whole product, which makes its processing difficult. Because the carbon fiber tent peg is wrapped by carbon fiber cloth, it is readily peeled off and broken when struck and has a short service life.

SUMMARY OF THE INVENTION

The purpose of this invention is to overcome the defects of the prior art, and provide a simple-structure, lightweight and durable tent peg. The other purpose of this invention is to provide a processing method of the tent peg.

The purpose of this invention is realized by the following technical solution:

A tent peg comprises a tent peg cover, a tent peg prong and a prism shape tent peg body; wherein the tent peg cover and the tent peg prong are made of alloy, the tent peg body is made of carbon fiber, the tent peg cover is disposed on a top side of the tent peg body, and the tent peg prong is disposed at a bottom side of the tent peg body.

Further, the tent peg body is provided with a cut out pattern.

Further, the alloy is zinc alloy or titanium alloy.

Further, a first locking plate is provided on the top side of the tent peg body; a second locking plate is provided at the bottom side of the tent peg body; the tent peg cover is connected to the first locking plate, and the tent peg prong is connected to the second locking plate.

Further, one side of the first locking plate is provided with a first groove, and another side of the first locking plate is provided with a second groove; the tent peg cover is provided with a first locking groove, a top side of the first locking groove serves as a knocking side, a first tenon is vertically connected to one end of the first locking groove, and a first opening is provided between the first tenon and another end of the first locking groove; when the tent peg cover is connected to the first locking plate, the first locking plate passes through the first opening and fits into the first locking groove, so that the first tenon is connected to the first groove and said another end of the first locking groove is connected to the second groove.

Further, one side of the second locking plate is provided with a third groove, and another side of the second locking plate is provided with a fourth groove; the tent peg prong comprises a second locking groove and a prong connected vertically, a second tenon is vertically connected to one end of the second locking groove, and a second opening is provided between the second tenon and another end of the second locking groove; when the tent peg prong is connected to the second locking plate, the second locking plate passes through the second opening and fits into the second locking groove, so that the second tenon is connected to the third groove and said another end of the second locking groove is connected to the fourth groove.

Further, the prong is in a regular quadrangular pyramidal shape, a regular triangular pyramidal shape or a conical shape.

Further, the tent peg comprises a first adhesive layer and a second adhesive layer; the tent peg cover is connected to the top side of the tent peg body through the first adhesive layer; the tent peg prong is connected to the bottom side of the tent peg body through the second adhesive layer.

Further, the tent peg comprises a first anti-slipping clasp and a second anti-slipping clasp, the first anti-slipping clasp and the second anti-slipping clasp being mounted respectively on two sides of the tent peg body.

A processing method of the tent peg comprises the following steps:

- carving a carbon fiber sheet to provide the tent peg body;
- providing the tent peg cover and the tent peg prong by a die casting machine;
- disposing the tent peg cover on the top side of tent peg body, and disposing the tent peg prong at the bottom side of the tent peg body;
- dripping an adhesive into gaps between the tent peg body, the tent peg cover and the tent peg prong to form the first adhesive layer and the second adhesive layer so that the tent peg is consolidated.

Further, the adhesive is an epoxy adhesive or a silicone adhesive.

The principle of this invention is: by using carbon fiber material to make a tent peg body with a cut out pattern, the weight of the tent peg may be greatly reduced; the flexibility of carbon fiber material could combine the tent peg body with the alloy tent peg prong and tent peg cover firmly through a locking structure, which improves the anti-knocking and anti-striking ability of the tent peg.

Compared with the prior art, this invention has advantages as below:

1. The tent peg body of this invention is in a prism shape rather than the traditional cylinder shape, which could enlarge the contact area with the ground and effectively prevent the tent peg from detaching from the ground; the tent peg body is made of carbon fiber, and the tent peg cover and the tent peg prong are made of alloy, which could thereby effectively reduce the weight of the tent peg and also greatly improve the anti-knocking ability of the tent peg cover and anti-striking ability of the tent peg prong.

2. A cut out pattern is provided on the tent peg body, which could reduce the weight the tent peg maximally. The weight of an entire tent peg is less than 6 g, which has been reduced a half compared to the weight of current ultralight tent pegs. For the mountaineering and long-distance trekking participants, it can effectively reduce their burden. Mud, sand or snow could also go into the cut out pattern when the ground around the tent peg is being pressed or consolidated after the tent peg is inserted on the ground. When the filler inside the cut out pattern links back with the ground firmly, the tent peg could be griped firmly by the ground. This effect is more outstanding when the filler is snow, which then turns into ice.

3. A special locking structure is provided between the tent peg cover and the tent peg body, and between the tent peg prong and the tent peg body, that is, the top side of the tent peg body is connected to the first locking groove of the tent peg cover through the first locking plate, and the bottom side of the tent peg body is connected to the second locking groove of the tent peg prong through the second locking plate, so that the tent peg cover and the tent peg prong are connected to the tent peg body firmly and do not easily fall off.

4. This invention use adhesive layers to fill the gap between the tent peg cover and the tent peg body and also the gap between the tent peg prong and the tent peg body, which could greatly improve the firmness of the tent peg.

Wherein, 1 is the tent peg cover, 2 is the tent peg prong, 3 is the tent peg body, 4 is the cut out pattern, 5 is the first locking plate, 6 is the second locking plate, 7 is the first groove, 8 is the second groove, 9 is the first tenon, 10 is the third groove, 11 is the fourth groove, 12 is the second tenon, 13 is the first anti-slipping clasp, 14 is the second anti-slipping clasp, 15 is the first locking groove, 16 is the second locking groove, 17 is the prong 18 is the first adhesive layer, 19 is the second adhesive layer.

DETAILED DESCRIPTION OF THE EMBODIMENTS

The invention is further described below in combination with the attached drawings and preferred embodiments.

Figure 1:
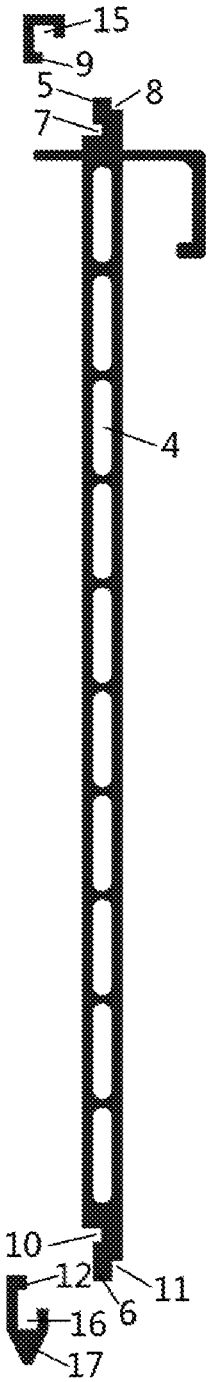
FIG. 1 is a structural diagram of the tent peg of the invention before assembled.
Figure 2:
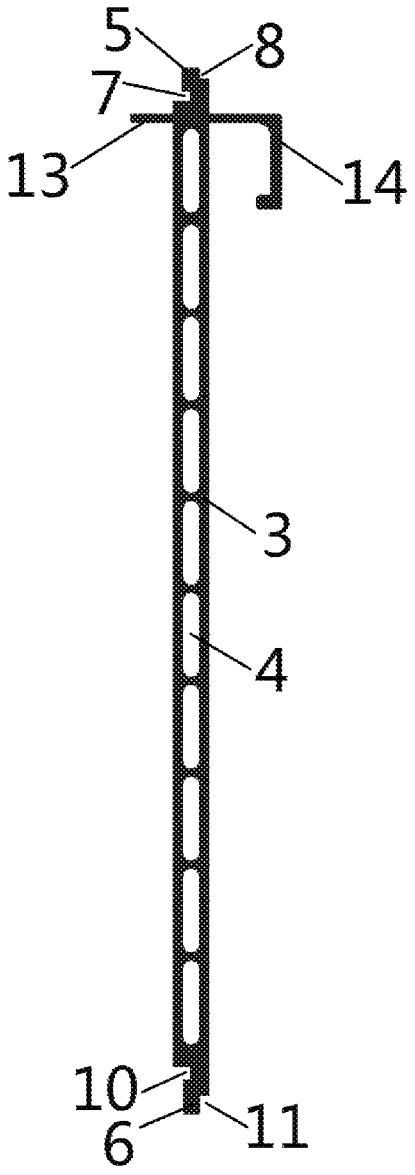
FIG. 2 is a structural diagram of the tent peg body of the invention.
Figure 3:
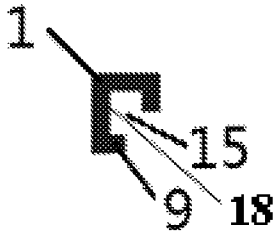
FIG. 3 is a structural diagram of the tent peg cover of the invention.
Figure 4:
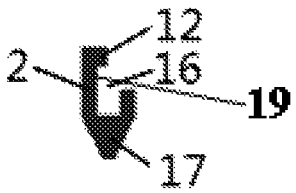
FIG. 4 is a structural diagram of the tent peg prong of the invention.
Figure 5:
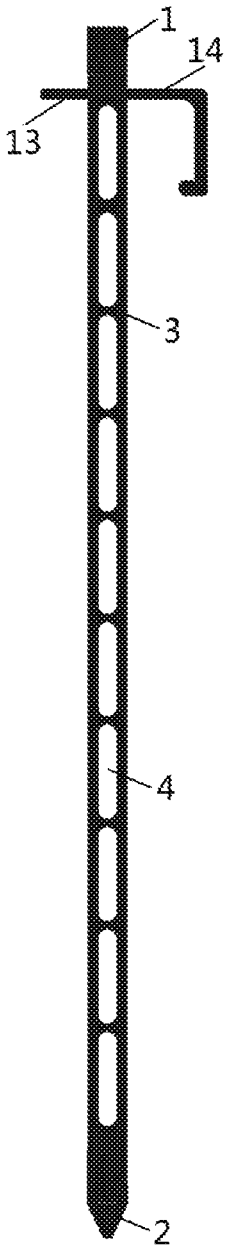
FIG. 5 is a structural diagram of the tent peg of the invention after assembled.

As shown in FIG. 1-2, the tent peg comprises a tent peg cover 1, a tent peg prong 2 and a prism shape tent peg body 3; the tent peg cover 1 and the tent peg prong 2 are made of alloy, and the tent peg body 3 is made of carbon fiber; the tent peg cover 1 is disposed on a top side of the tent peg body 3, and the tent peg prong 2 is disposed at a bottom side of the tent peg body 3. The tent peg body 3 may be a regular quadrangular prism, a regular triangular prism or other regular prism. The regular prism shape tent peg body 3 has a firm structure with large contact area with the ground, which effectively prevents the tent peg from detaching from the ground. The tent peg body 3 is made of carbon fiber, and the tent peg cover 1 and the tent peg prong 2 are made of alloy material, which thereby effectively reduces the weight of the tent peg and also greatly improves the anti-knocking and anti-striking ability of the tent peg. The flexible carbon fiber material could combine with the alloy tent peg cover 1 and tent peg prong 2 firmly through a locking structure.

The tent peg body 3 has a cut out pattern 4, which could decorate the tent peg and also reduce the weight of the tent peg. The cut out pattern 4 could be altered into other figures flexibly.

The alloy could be zinc alloy or titanium alloy. The tent peg cover 1 and the tent peg prong 2 are made of zinc alloy or titanium alloy, so that the tent peg cover 1 could sustain certain knocking strength, and the tent peg prong 2 could sustain certain impact strength, thereby prolonging the service life of the tent peg.

A first locking plate 5 is provided on the top side of the tent peg body 3; a second locking plate 6 is provided at the bottom side of the tent peg body 3; the tent peg cover 1 is connected to the first locking plate 5, and the tent peg prong 2 is connected to the second locking plate 6.

One side of the first locking plate 5 is provided with a first groove 7, and another side of the first locking plate 5 is provided with a second groove 8; the tent peg cover 1 is provided with a first locking groove 15, a top side of the first locking groove 15 serves as a knocking side, a first tenon 9 is vertically connected to one end of the first locking groove 15, and a first opening is provided between the first tenon 9 and another end of the first locking groove 15; when the tent peg cover 1 is connected to the first locking plate 5, the first locking plate 5 passes through the first opening and fits into the first locking groove 15, so that the first tenon 9 is connected to the first groove 7 and said another end of the first locking groove 15 is connected to the second groove 8. Lengths of the two ends of the first locking groove 15 can be identical or different. To facilitate the assembly, one end of the first locking groove in this embodiment is longer than the other. The knocking side refers to the side being knocked when the tent peg is used. By knocking the knocking side the tent peg may be inserted into the ground so as to fix the tent or rope.

Further, one side of the second locking plate 6 is provided with a third groove 10, and another side of the second locking plate 6 is provided with a fourth groove 11; the tent peg prong 2 comprises a second locking groove 16 and a prong 17 connected vertically, a second tenon 12 is vertically connected to one end of the second locking groove 16, and a second opening is provided between the second tenon 12 and another end of the second locking groove 16; when the tent peg prong 2 is connected to the second locking plate 6, the second locking plate 6 passes through the second opening and fits into the second locking groove 16, so that the second tenon 12 is connected to the third groove 10 and said another end of the second locking groove 16 is connected to the fourth groove 11. Lengths of the two ends of the second locking groove can be identical or different. To facilitate the assembly, one end of the second locking groove 16 in this embodiment is longer than the other. By connecting the first locking plate 5 to the first locking groove 15 and connecting the second locking plate 6 to the second locking groove 16, the locking structures allow the tent peg to form an integrated structure, which are highly firm, not readily detached, and have a long service life.

The prong 17 is in a regular quadrangular pyramidal shape, a regular triangular pyramidal shape or a conical shape. The prong 17 could be changed into other shapes according to practical circumstance. The knocking side of the tent peg cover 1 can be a circle, a rectangle or any other shape. When the prong 17 is in a conical shape and the knocking side is a circle, the problem that a traditional round cover and round prong cannot be installed on a prism shape tent peg body may be solved.

The tent peg further comprises a first adhesive layer 18 and a second adhesive layer 19; the tent peg cover 1 is connected to the top side of the tent peg body 3 through the first adhesive layer 18; the tent peg prong 2 is connected to the bottom side of the tent peg body 3 through the second adhesive layer 19. The first adhesive layer 18 and the second adhesive layer 19 strengthen the connecting structures among the tent peg cover 1, the tent peg prong 2 and the tent peg body 3, thereby improving the firmness of the tent peg.

The tent peg further comprises a first anti-slipping clasp 13 and a second anti-slipping clasp 14, the first anti-slipping clasp 13 and the second anti-slipping clasp 14 being mounted respectively on two sides of the tent peg body 3. The first anti-slipping clasp 13 and second anti-slipping clasp 14 facilitate the user to fix the rope and may improve the efficiency of tent installation.

A processing method of the tent peg comprises the following steps:

carving a carbon fiber sheet (thickness≥5 mm) to obtain the tent peg body 3, wherein the first locking plate 5 on the top side of the tent peg body 3, the second locking plate 6 at the bottom side of the tent peg body 3 and the cut out pattern 4 are all obtained by carving;

providing the tent peg cover 1 and the tent peg prong 2 by a die casting machine;

disposing the tent peg cover 1 on the top side of tent peg body 3, and disposing the tent peg prong 2 at the bottom side of the tent peg body 3;

dripping an adhesive into gaps between the tent peg cover 1, the tent peg prong 2 and the tent peg body 3. When the first adhesive layer and the second adhesive layer are cured, a completed tent peg is obtained The adhesive is an epoxy adhesive or a silicone adhesive, etc. Adding the adhesive could extend the durability of the tent peg.

The above embodiment is a preferred embodiment of this invention, but this invention is not limited thereto, and any change or equivalent substitution that does not depart from the technical solution of this invention are all included in the protection scope of this invention.

I claim:

1. A tent peg, comprising a tent peg cover, a tent peg prong and a prism shape tent peg body; wherein the tent peg cover and the tent peg prong are made of alloy, the tent peg body is made of carbon fiber, the tent peg cover is disposed on a top side of the tent peg body, and the tent peg prong is disposed at a bottom side of the tent peg body;

wherein a first locking plate is provided on the top side of the tent peg body; a second locking plate is provided at the bottom side of the tent peg body; the tent peg cover is connected to the first locking plate, and the tent peg prong is connected to the second locking plate.

2. The tent peg according to claim 1, wherein the tent peg body is provided with a cut out pattern.

3. The tent peg according to claim 1, wherein the alloy is zinc alloy or titanium alloy.

4. The tent peg according to claim 1, wherein one side of the first locking plate is provided with a first groove, and another side of the first locking plate is provided with a second groove; the tent peg cover is provided with a first locking groove, a top side of the first locking groove serves as a knocking side, a first tenon is vertically connected to one end of the first locking groove, and a first opening is provided between the first tenon and another end of the first locking groove; when the tent peg cover is connected to the first locking plate, the first locking plate passes through the first opening and fits into the first locking groove, so that the first tenon is connected to the first groove and said another end of the first locking groove is connected to the second groove.

5. The tent peg according to claim 1, wherein one side of the second locking plate is provided with a third groove, and another side of the second locking plate is provided with a fourth groove; the tent peg prong comprises a second locking groove and a prong connected vertically, a second tenon is vertically connected to one end of the second locking groove, and a second opening is provided between the second tenon and another end of the second locking groove; when the tent peg prong is connected to the second locking plate, the second locking plate passes through the second opening and fits into the second locking groove, so that the second tenon is connected to the third groove and said another end of the second locking groove is connected to the fourth groove.

6. The tent peg according to claim 1, further comprising a first adhesive layer and a second adhesive layer; the tent peg cover is connected to the top side of the tent peg body through the first adhesive layer; the tent peg prong is connected to the bottom side of the tent peg body through the second adhesive layer.

7. The tent peg according to claim 1, further comprising a first anti-slipping clasp and a second anti-slipping clasp, the first anti-slipping clasp and the second anti-slipping clasp being mounted respectively on two sides of the tent peg body.

8. A processing method of the tent peg according to claim 1, comprising the following steps:

carving a carbon fiber sheet to provide the tent peg body;

providing the tent peg cover and the tent peg prong by a die casting machine;

disposing the tent peg cover on the top side of tent peg body, and disposing the tent peg prong at the bottom side of the tent peg body.

9. The processing method of the tent peg according to claim 8, further comprising dripping an adhesive into gaps between the tent peg body, the tent peg cover and the tent peg prong.

* * * * *